US005265885A

United States Patent [19]

Blount

[11] Patent Number: 5,265,885

[45] Date of Patent: Nov. 30, 1993

[54] USER CONFIGURED MAGNET TOSSING GAME

[76] Inventor: Clarence R. Blount, 5228 Lakeview Rd., North Little Rock, Ark. 72216

[21] Appl. No.: 991,370

[22] Filed: Dec. 15, 1992

[51] Int. Cl.[5] ..... A63B 67/06

[52] U.S. Cl. ..... 273/345; 273/239; 273/271

[58] Field of Search ..... 273/345, 126 A, 239, 273/271, 443

[56] References Cited

U.S. PATENT DOCUMENTS

| | | | |
|---|---|---|---|
| 2,511,774 | 6/1950 | Goldsmith | 273/239 |
| 3,090,622 | 5/1963 | Sire | 273/126 A |
| 3,232,620 | 2/1966 | Schoolcraft et al. | 273/239 |
| 3,427,029 | 2/1969 | Riva | 273/239 |
| 3,765,679 | 10/1973 | O'Connell | 273/239 |
| 3,870,308 | 3/1975 | Reilly | 273/126 A |
| 4,080,736 | 6/1977 | Petrusek | 273/345 |
| 4,103,894 | 8/1978 | McCraw | 273/126 A |
| 4,293.133 | 10/1981 | Baron et al. | 273/345 |
| 4,834,371 | 5/1989 | Hay et al. | 273/126 A X |
| 5,102,129 | 4/1992 | Roberts | 273/239 X |

*Primary Examiner*—William H. Grieb
*Attorney, Agent, or Firm*—Stephen D. Carver; Jerry L. Mahurin

[57] ABSTRACT

A user configured magnet tossing game for play by one or more players. The game comprises a plurality of magnets embedded in the floor of an enclosure to create magnetic areas. A playing surface is defined on each side of several user-selected, replaceable game boards towards which pieces are thrown. A transparent shield may be disposed over the playing surface to protect it from being marred. The target areas on the playing surfaces align with the underlying magnetic areas. A set of rules governs the play of a game on each of the playing surfaces. The game pieces are colored, disc-shaped ceramic magnets. The game pieces are tossed onto the playing surface, the object being to land a game piece on one of the target areas to achieve a goal disclosed in the rules. An innumerable variety of games is possible employing the game apparatus. The rules include procedures for playing and scoring a series of link-up games, a baseball game, a phrase construction game, a color match game, a twenty one or bust game and a word construction game.

8 Claims, 8 Drawing Sheets

USER CONFIGURED MAGNET TOSSING GAME

BACKGROUND OF THE INVENTION

This invention broadly relates to board games. Specifically the present invention is a tossing game employing magnetic game pieces and magnetic target areas. Art pertinent to the present invention is classified in numerous subclasses within U.S. Pat. Class 273.

Numerous games employing magnetic elements are known in the art. For example, numerous "travel" games employ magnetic playing pieces along with a metallic board. These games are intended to be used in a moving vehicle or the like. The primary purpose of the magnets in such games is to hold the pieces stationary so that a game, such as chess or checkers, can be played without disruption. Upon review of the prior art it is seen that many games employ magnetic fields of alternating polarity to add an element of chance to the game.

U.S. Pat. No. 4,103,894 issued Aug. 1, 1978, uses magnetic "parasites" as obstacles and magnetic playing pieces.

Use of magnetic game pieces are evident in patents such as Reilly U.S. Pat. No. 3,870,308 and Riva U.S. Pat. 3,427,029. The former discloses a game which employs both a magnetic target and magnetic pieces. This game is a "shuffle board" type game, in which competitors attempt to dislodge the disc of an opponent. Riva discloses a tic-tac-toe type game that uses the repulsion and attraction of magnetic fields to add an element of chance to the game. Furthermore, it employs game pieces which flip, as a result of magnetic fields.

Magnets are often used to effectuate the movement of game pieces as disclosed in Hay U.S. Pat. No. 4,834,371 issued May 30, 1989. This patent discloses a game board with multiple layers intended to accommodate a number of magnetic control paddles. Basically, this invention is intended for use with games replicating hockey, soccer or the like.

U.S. Pat. No. 4,030,736, Petrusek, issued Jun. 21, 1977, discloses a tossing game intended to be hung on the wall. The playing board is metallic while the game pieces themselves are magnetic. This game is similar to magnetic darts or the like.

Roberts, U.S. Pat. 5,102,129 issued Apr. 7, 1992, discloses a hopscotch system employing thin sheets of plastic with magnets secured within. The sheets of plastic are intended to be laid out in a variety of hopscotch patterns. A group of markers is tossed onto the sheets to effectuate the play of hopscotch. Additionally, the adjacent magnetic areas are alternately disposed with the poles in opposite directions to add an element of chance to the placement of the markers.

U.S Pat. No. 3,765,679 issued to O'Connell on Oct. 16, 1973 employs magnetic areas disposed below a board and magnetic game pieces. An opponents piece is captured in this game whenever the magnetic field of ones piece is properly aligned to attract the opponents piece.

Schoolcraft U.S. Pat. No. 3,232,620 discloses a game employing magnets hidden below a surface. In particular this game employs paramagnetic portions within a game board to facilitate the play of a game depicting the climbing of a mountain. The game pieces are magnetic as well.

Most pertinent to the present invention, U.S. Pat. No. 3,090,622 issued May 21, 1963, to Sire, discloses a tic-tac-toe game employing magnetic markers and magnetic target areas. This game employs a cue type device to move the markers. The markers are played upon the tic tac toe area in a rebounding fashion off the sidewalls of the game.

It is desirous to provide a game that employs magnetic game pieces and a game surface employing magnetic surfaces wherein the magnetic fields are disposed in alignment. I have found that considerable player enthusiasm results from the challenges in scoring achieved with such an arrangement.

The prior art fails to provide a set of analogous, convertible game modules allowing the use of magnetic fields to attract and otherwise interact with game pieces. Therefore, it is desirous to provide a game system in which different modular overlays may be employed to play various games upon a base incorporating the aforementioned co-polar magnetic areas.

SUMMARY OF THE INVENTION

My game overcomes the shortcomings in the prior art by providing a game which employs the combined magnetic fields of a target area and a game piece. It can be disposed in numerous playing orientations selected by the players. The game is challenging and enjoyable.

To accomplish this goal the preferred embodiment of my game employs magnetic game pieces and a game surface employing magnetic areas wherein the magnetic areas are disposed with the same pole upward. Additionally, different overlays or game modules are disclosed to play various games within an enclosure incorporating the aforementioned co-polar magnetic areas. The present invention can be used as a travel game as well.

My game is housed within an outer box having a cover. The box has slots for storage of playing pieces of various colors and scoring pads. A playing enclosure is housed in the outer box.

The playing enclosure is square with vertical walls and a floor. The walls and floor may be the sides and bottom of the outer box. The enclosure receives a game module board and a transparent shield. Each board has a playing surface on each side. All the boards and the shield can be stored in the enclosure. Disc shaped magnets are embedded in the material comprising the floor of the enclosure to create magnetic areas.

The game pieces are disc shaped ceramic magnets having the same diameter as the magnets embedded in the floor of the playing enclosure. Each game piece is of a color representing a particular player. Generally speaking the game pieces can be stacked with similar poles aligned to assist in storage and play of the game.

A set of rules govern the play of a game on each of the playing surfaces. A board is disposed within the enclosure. Thus placed, target areas, designated by circles of various colors and indicia, align with the underlying magnetic areas. The game pieces are tossed onto the playing surface. The object of the game is to "land" a game piece on one of the target areas to achieve a goal disclosed in the rules. An innumerable variety of games is possible employing the herein disclosed game apparatus. A few sets of such rules are disclosed in the following detailed description. However, generally speaking only one game board should be placed in the playing enclosure at a time, other than for storage. The transparent shield should always be disposed over the playing surface to protect it from being damaged. Play consists of tossing the colored game pieces onto the shield protected playing surface disposed within the playing enclosure. A player's hand must never be directly over any portion of the playing surface during a toss. Tosses must always be upwardly directed, never downwardly. Game pieces not firmly attached to a target area are referred to as "Junk".

Rules provided include procedures for playing and scoring a series of link-up games, a baseball game, a phrase construction game, a color match game, a twenty one or bust game and a word construction game.

A playing surface is disclosed wherein random points are awarded or deducted for tossing game pieces. Unlike the other playing surfaces, it does not employ all of the magnetic areas underneath the playing surface. Hence, this playing surface comprises parasite areas which will prevent a game piece from reaching a target area.

Therefore a primary object of the present invention is to provide a toss game which can be user configured.

A related object is to provide a toss game of the character described that employs magnetic target areas.

A similar object of the present invention is to provide a game which employs magnetic game pieces.

Another object of the present invention is to provide a game which employs magnetic target areas with similar poles aligned.

A related object of the present invention is to provide a game wherein the magnetic attraction between game pieces and target area is relatively great.

An object of the present invention is to provide a game which is enjoyable for play by both children and adults.

Another primary object of the present invention is to provide a game in which the user may select between a variety of target tossing games by selecting a game module board.

A further object of the present invention is to provide an educational game to aid learning spelling and logic thought processes.

Another object of the present invention is to provide a game which differs from conventional board games which may be played during travel.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 2:
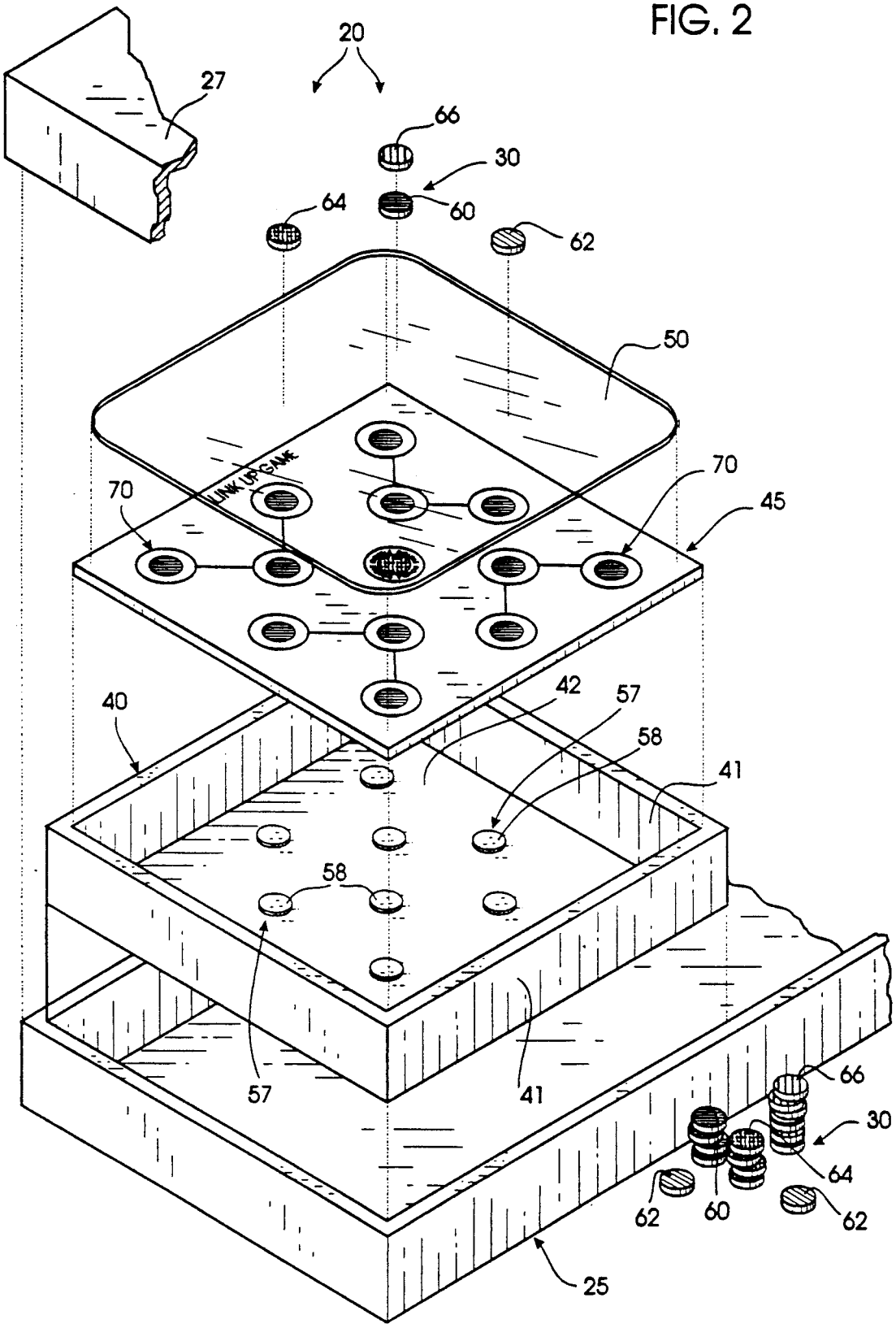
FIG. 2 is an exploded, partially fragmented isometric view of the preferred embodiment illustrating the location of the magnetic areas within the playing enclosure.

With reference now to the accompanying drawings, the best mode of my User Configured Magnet Toss Game is generally designated by the reference numeral 20. Generally speaking it is housed within a generally rectangular, outer box 25 which has an accompanying cover 27 (FIG. 2). The box accommodates stacked game pieces 30 of various colors disposed within horizontal slots 32 for storage. The scoring pads 34 may be stored within an adjacent compartment. A playing enclosure 40 is normally packaged within box 25.

The playing enclosure 40 is preferably square, having vertical side walls 41 and a floor 42. Preferably these walls 41 and floor 42 are separate from the outer box 25, as illustrated. Alternatively, the side walls 41 and floor 42 may be the bottom and sides of the outer box 25. Regardless, the enclosure 40 is adapted to receive one or more user-selectable game boards 45–49. The opposite playing surfaces on the game boards have been denoted by the same reference numerals with the suffixes "A" and "B" for convenience. An optional protective, transparent shield 50 is preferably placed on the selected game board to protect its playing surface. Board 45 has a different playing surface 45A and 45B on opposite sides. During play only a single board 45 is disposed within the enclosure 40. The transparent shield 50 covers the exposed playing surface of the selected board to prevent marring.

Magnetic areas 57 are disposed about the floor 42 of the playing enclosure 40. The magnetic areas 57 are preferably comprised of a disc shaped magnet 58 embedded in the material comprising the floor 42 of the enclosure 40. Also in the preferred embodiment the pole of the magnets 58 will be similarly aligned. In other words, all the magnets 58 embedded in the floor 42 will have the same pole facing upward. The targets 70 disposed on the various playing surfaces of the various game boards are generally, but not always, aligned with magnets 58.

Figure 1:
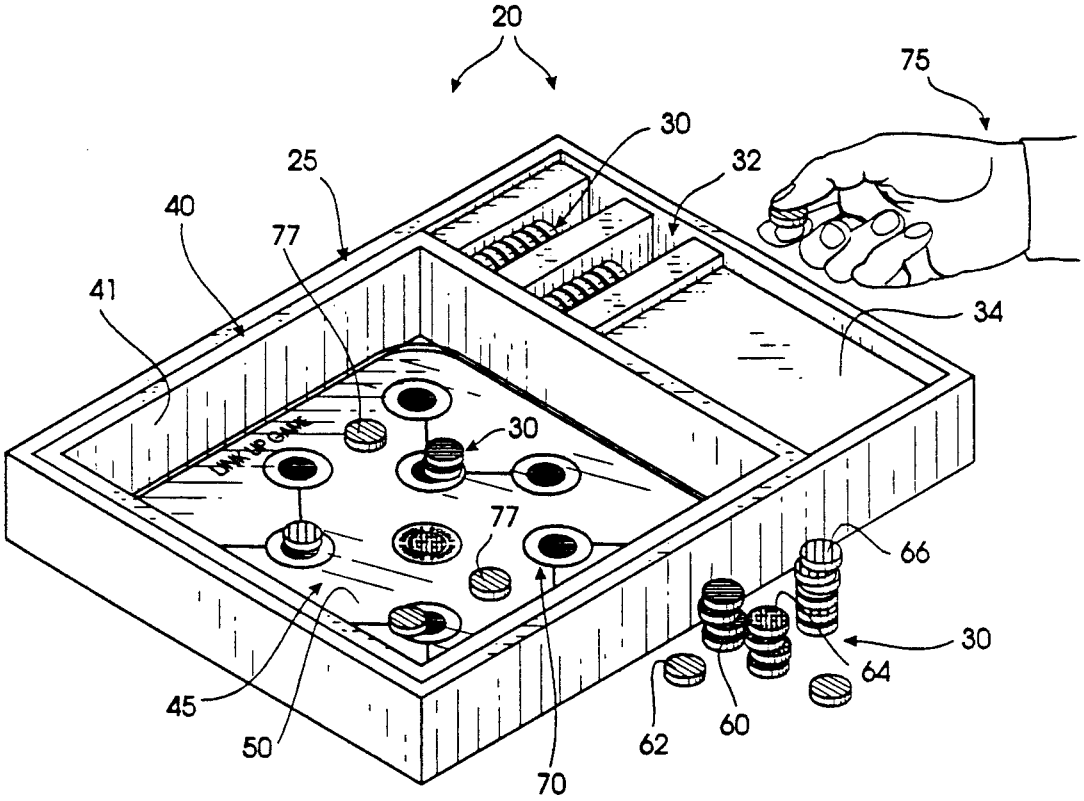
FIG. 1 is an isometric, environmental view of the preferred embodiment of my User Configured Magnet Toss Game.
Figure 3:
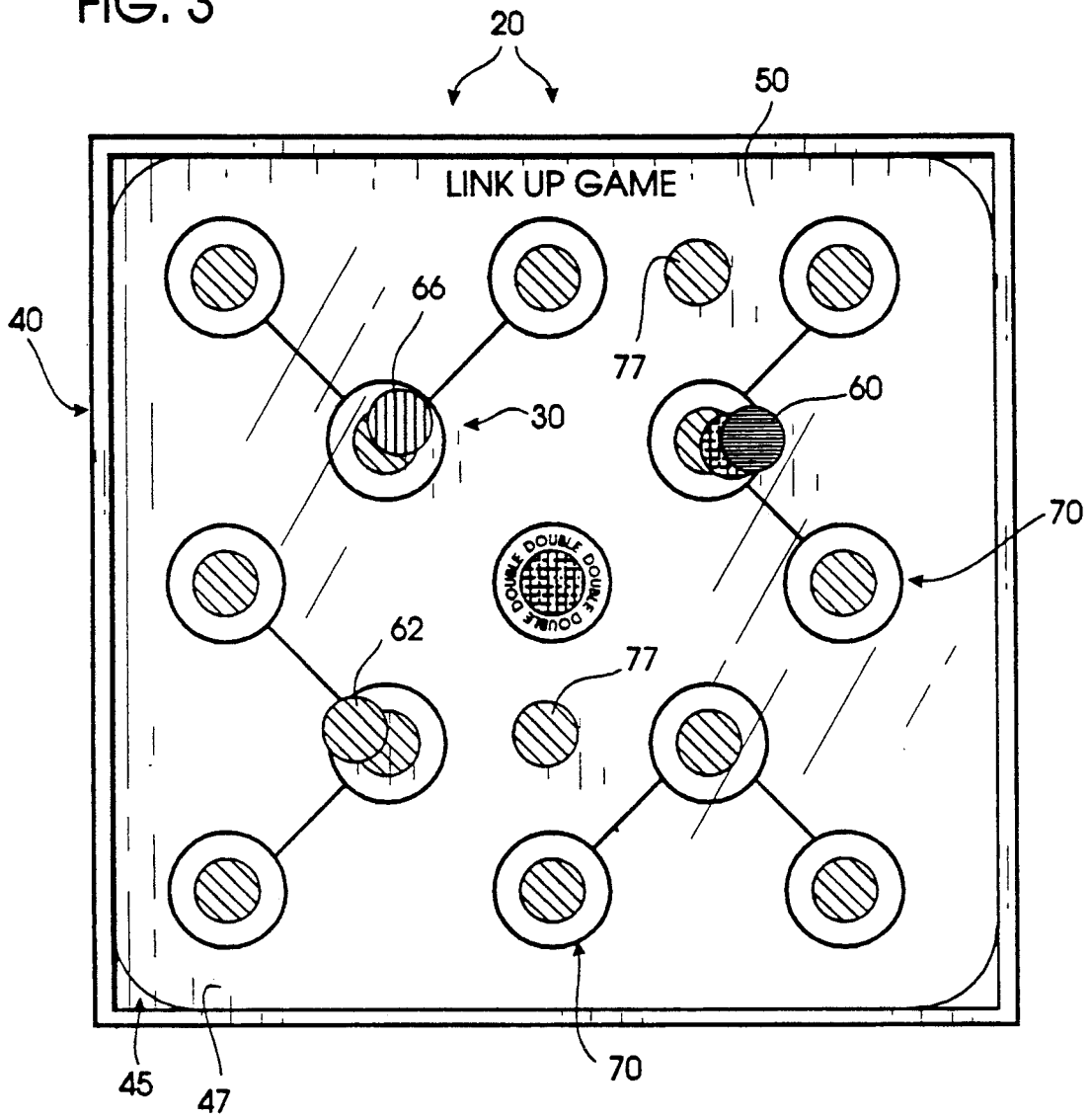
FIG. 3 is a top plan view of the game showing the playing enclosure with a game module and a transparent shield deployed therein.
Figure 4A:
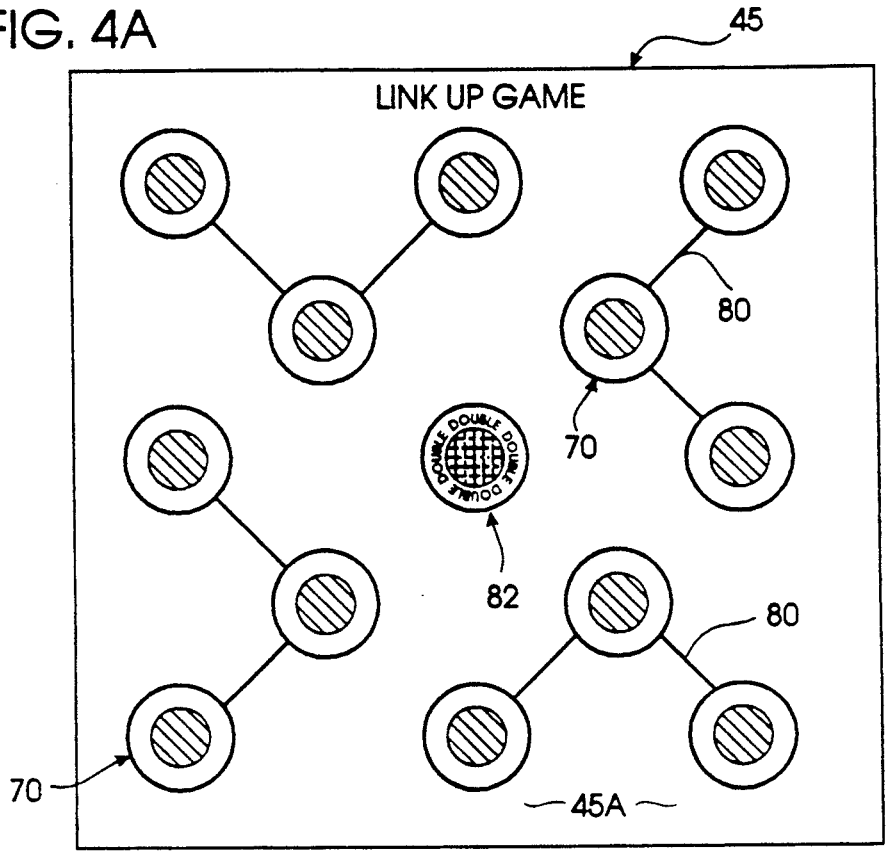
FIG. 4A is a top plan view of a first "link up" playing surface.
Figure 4B:
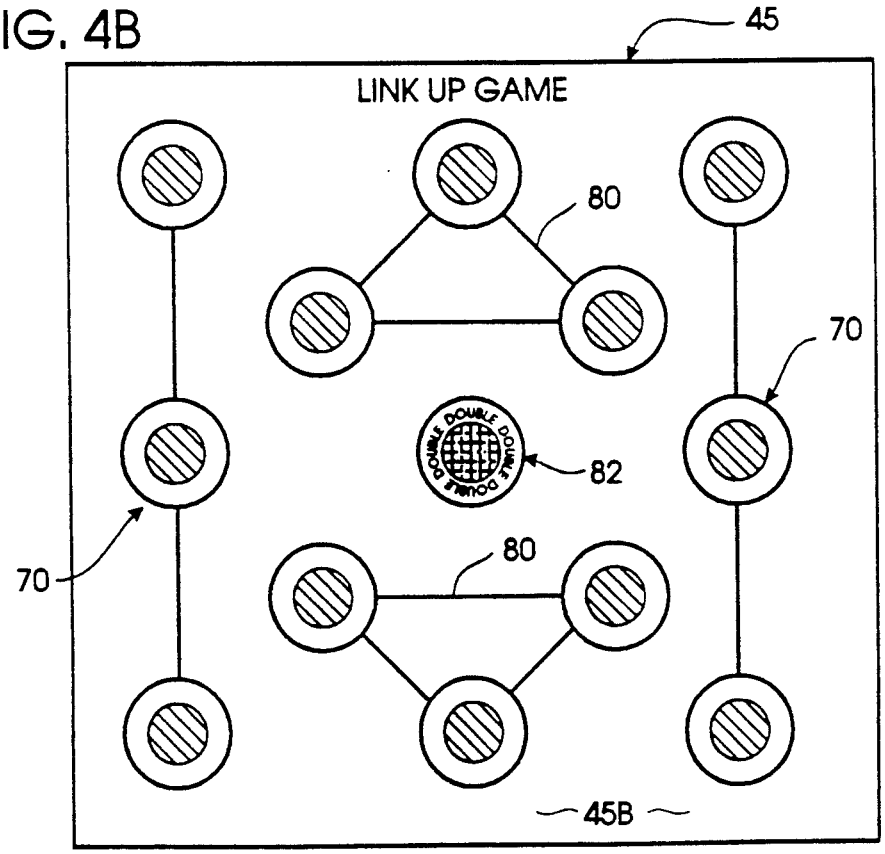
FIG. 4B is a top plan view of a second "link up" playing surface.

The games pieces 30 are preferably disc shaped and roughly the size of the magnets 58 embedded in the floor 42 of the playing enclosure 40. They are preferably constructed of a ceramic magnetic material. Each game piece 30 is of a color representing a particular player. For example the pieces 30 may be colored as illustrated by the shading in FIGS. 1,2 and 3; blue 60, green 62, yellow 64, or red 66. Generally speaking the game pieces 30 can be stacked with similar poles aligned as seen in FIGS. 1 and 2 to assist the player in the play of the game.

An accompanying set of rules govern, play on each playing surface. The boards 45–49 are disposed within the enclosure 40. Thus placed, various targets generally designated by the reference numeral 70, comprising circles or other geometric shapes of various colors and accompanying indicia, align with the underlying magnetic areas 57. The game pieces 30 are tossed onto the playing surface by a player 75. The game object is to "land" a game piece 30 on one of the targets 70 to achieve a goal disclosed in the rules. The present invention 20 can be used as a travel game as well.

RULES FOR VARIOUS GAMES

An innumerable variety of games is possible employing the herein disclosed game apparatus 20. The following are but a few.

GENERAL RULES

Only one game board 45 should be placed in the playing enclosure 40 at a time, other than for storage. The transparent shield 50 should always be disposed over the playing surface to protect it from being damaged. Play consists of tossing the colored game pieces 30 onto the shield protected playing surface disposed within the playing enclosure 40. A player's hand 75 must never be directly over any portion of the playing surface during a toss. Tosses must always be upwardly directed, never downwardly. Game piece 30 that are not firmly attached to a target 70 are referred to as s"Junk" 77.

I. LINK-UP GAMES (1 to 4 Players)

Board 45 (surfaces 45A and 45B) and board 46 , surface 46A, share the same rules. The playing surfaces each have thirteen targets 70. The targets 70 are interconnected by lines 80 extending between them.

To play, the Players set the game amount, (i.e. fifty, seventy-five, one hundred etc.). One Player tosses all ten game pieces 30 of the same color.

To score, the game pieces 30 must link-up three or five targets 70 as indicated on the playing surface by the lines 80 extending between the targets 70. Enter the total number of targets 70 linked up on a score pad 34. If a game piece 30 attaches to a "Double" target 82, double the score for that round.

To continue play, the other Players toss and score following the same procedure. Toss as many rounds as are necessary. The Winner is the first Player whose total score reaches the agreed upon amount.

II BASEBALL GAME (2 Players)

Figure 5A:
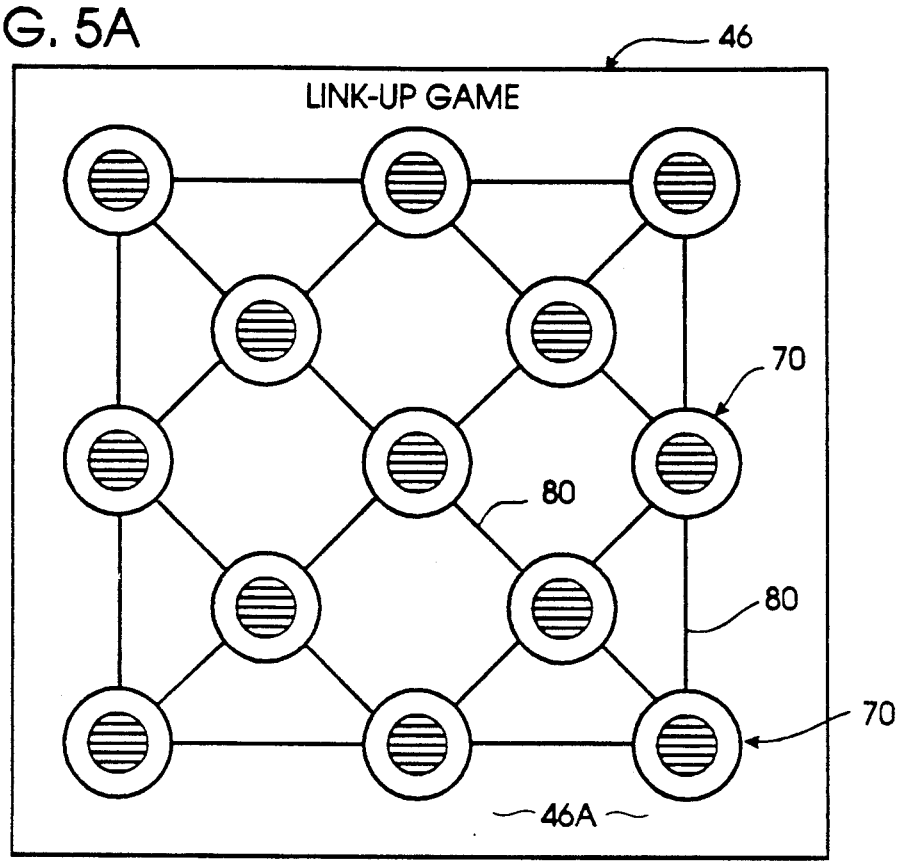
FIG. 5A is a top plan view of a third "link up" playing surface.
Figure 5B:
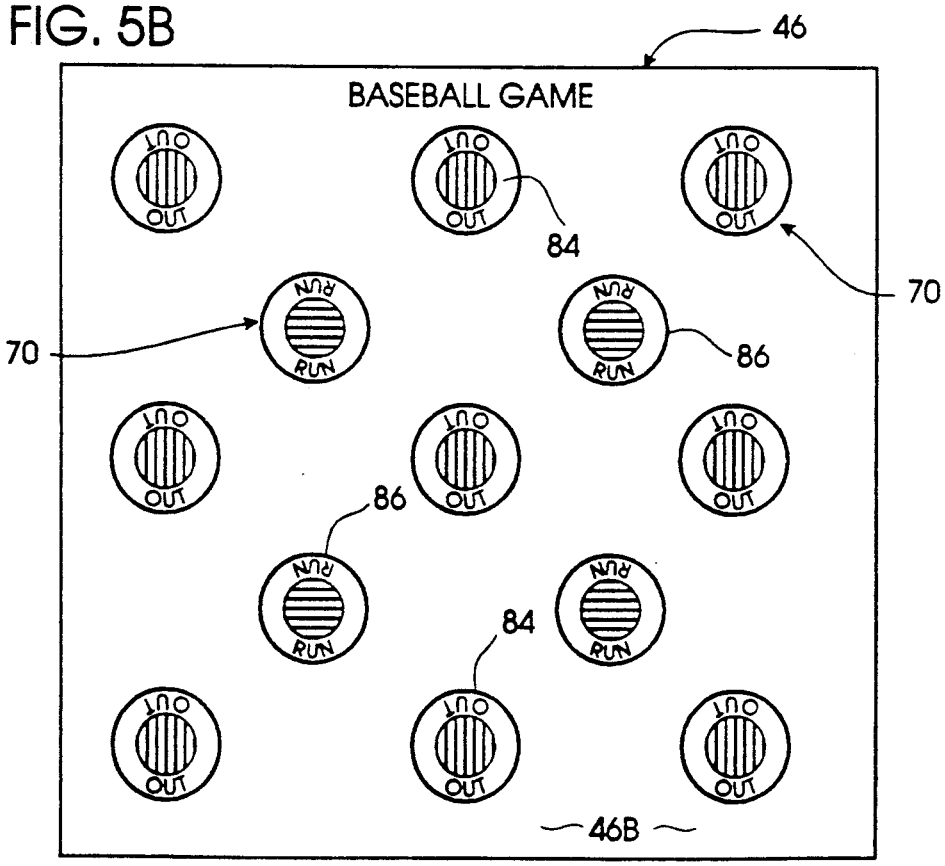
FIG. 5B is a top plan view of a "baseball" playing surface.

The Baseball playing surface 46B on board 46 has thirteen targets 70 (FIG. 5B). Nine red areas are designated as "OUTS" 84. The remaining four blue targets are designated as "RUNS" 86. The "visiting" Player begins the first inning by tossing ten game pieces 30 of the same color. If more than one game piece 30 attaches to any target area 70, it only counts as one "OUT" or one "RUN." Therefore, the objective is to attempt to aim away from a target area 70 already covered. If a game piece 30 is attached to a "RUN" target area 86 and another toss pulls it off, the run does not count. The same is true for "OUTS" 84.

If a Player tosses all ten game pieces 30 and still does not have three outs, remove the "junk" game pieces 77 and toss them again. If a Player covers all four RUN target areas 86 and still does not have three outs, remove game pieces 30 from the RUN target areas 86 and toss them until three OUTS are made.

After the "visiting" Player has three OUTS, enter the number of runs scored on the score pad 34 for the first inning. The "home" Player follows the same procedure. After the Players have tossed nine innings, the Player with the highest total scores is the Winner. If the score is tied after nine innings, toss additional complete innings until there is a Winner. III PHRASE GAME (1 to 4 Players)

Figure 6A:
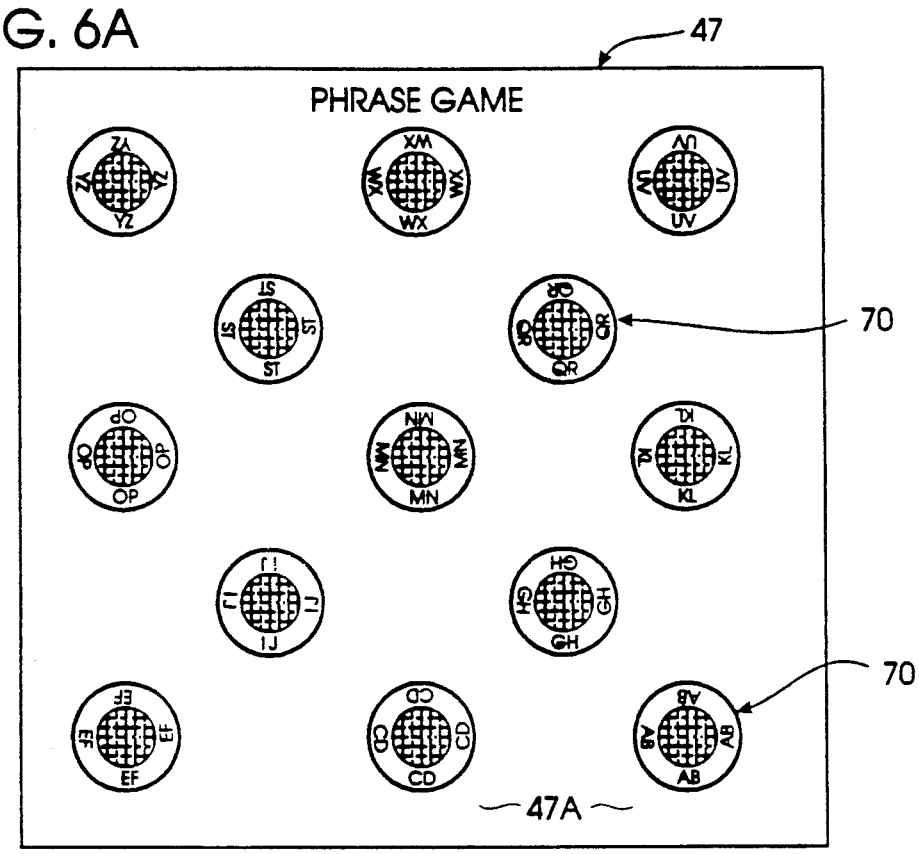
FIG. 6A is a top plan view of a phrase game.

Each of the thirteen yellow targets 70 on the playing surface 47A of board 47 (FIG. 6A) designate two letters of the alphabet. Prior to each game, the Players decide on a phrase to use as an objective. For example: ROSES ARE RED, VIOLETS ARE BLUE. Each Player prints this phrase on a score pad 34 leaving a small space between each letter.

To play, the first Player tosses ten game pieces 30 of the same color onto the playing surface. "Junk" 77 is removed. Then game pieces 30 are removed from the targets 70 one at a time and the corresponding letter in the phrase written on the first Player's score pad 34 is crossed out. For example, if game pieces 30 attach to targets AB, QR and SJ, that Player's phrase would be marked as follows:

O E E ED VIOLET E LUE

The following are some other phrases to use:"A Penny For Your Thoughts;" "The Washington Monument;" "Merry Christmas And A Happy New Year;" "The Golden Gate Bridge," and "The Yellow Rose of Texas."

IV COLOR-MATCH GAME (2 Players)

Figure 6B:
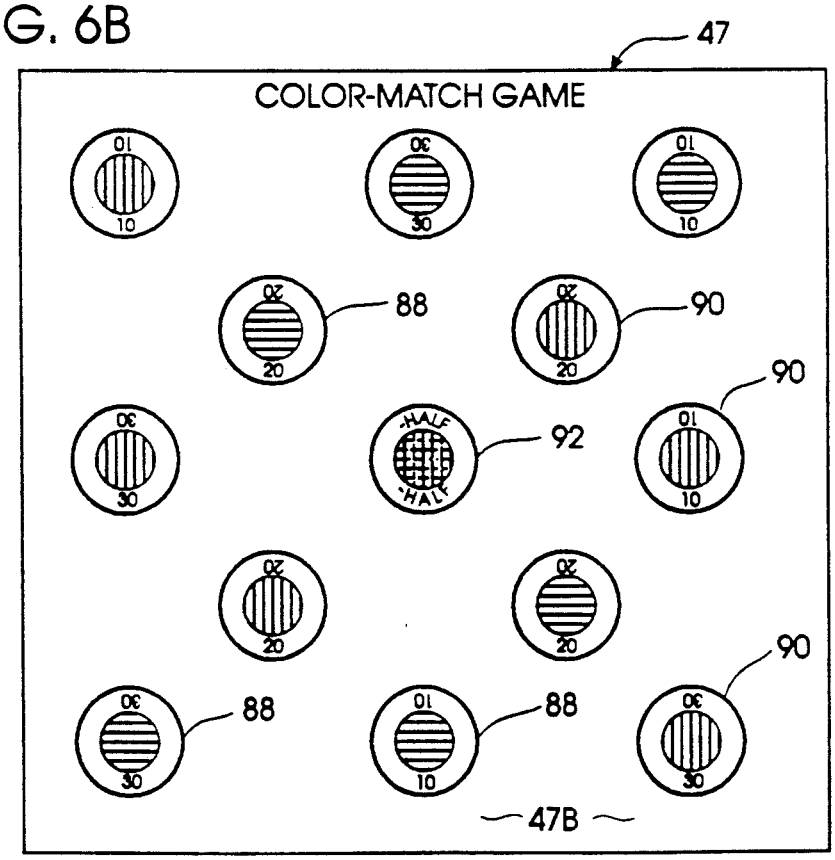
FIG. 6B is a top plan view of a color-matching game.

The playing surface 47B of board 47 (FIG. 6B) has thirteen targets 70: six blue targets 88, six red targets 90, and one yellow target 92. Points are assigned to the various different targets. There are two blue and two red target areas 88, 90 that count as ten, twenty and thirty points each. Yellow 92 reduces a Player's score by half.

To play, the Players set the game amount, (i.e. two, four or six hundred). The first Player begins the game with ten red game pieces 66. The second Player with ten blue 60. The red Player tosses one onto the playing surface 53, then the blue Player tosses. They alternate until both have tossed all ten game pieces 30.

To score the round, after the Players have completed their tosses, remove all "junk" 77. Score, only the game piece 30 on top of a stack. The red Player counts all red game pieces 66 on red target areas 90 and enters the total on a score sheet. The blue Player does the same for blue game pieces 60 and blue target areas 88. If a game piece 30 is attached to the yellow target area 92, deduct half of the total earned for that round for that Player. Points are only deducted for the top game piece. The point value of each target area 88, 90 counts only one time, regardless how many game pieces 30 are stacked on it.

Play continues for as many rounds as necessary for one Player to reach the agreed upon amount. The Winner is the first Player to reach the amount.

V. 21 OR BUST (2 Players)

Figure 7A:
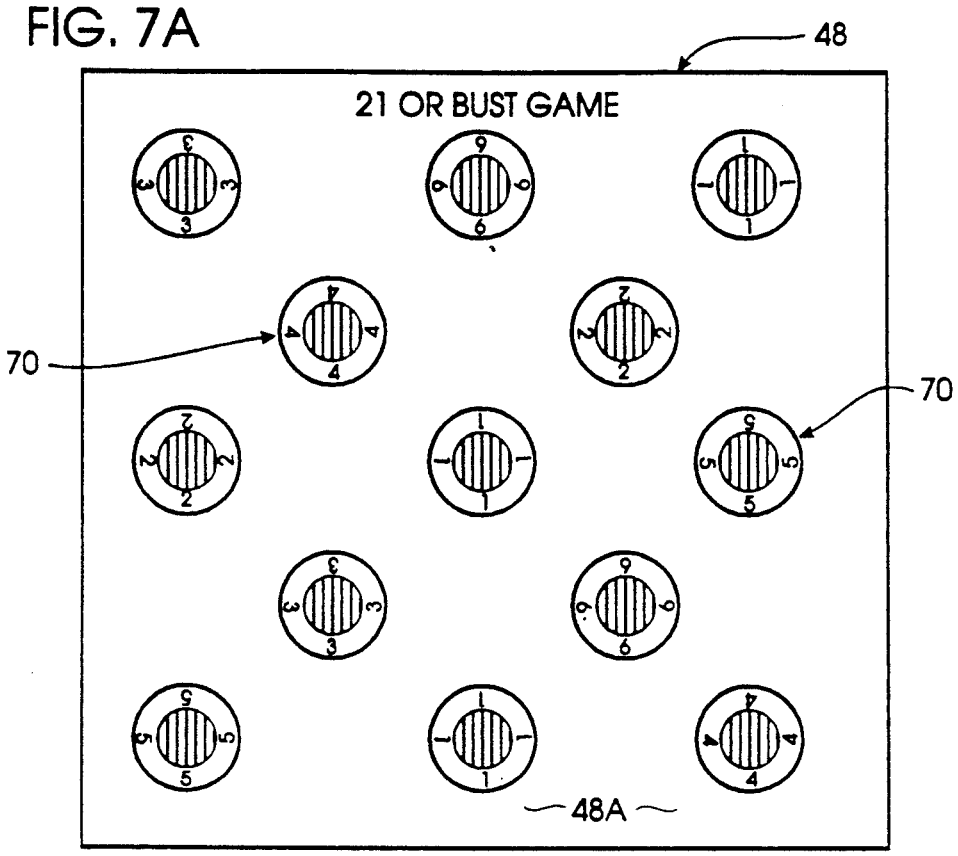
FIG. 7A is a top plan view of a "twenty-one or bust" game.

On the playing surface 48A of board 48 the thirteen red target areas 70 designate a number from one to six (FIG. 7A). The Players decide on the number of games to be played. Each Player begins the game with ten game pieces 30 of the same color. The object of the game is to score as many points as possible without exceeding Twenty-one.

To Play, the first Player tosses one game piece 30 onto the playing surface. If it does not attach to a target area 70, it is removed from the board and tossed until it does. The second Player follows the same procedure. Play alternates for the remainder of the game. If an attached game piece 30 is pulled off of a target area 70 and does not reattach to another, that game piece 30 is removed from the board and given to its Player to be tossed again.

In scoring, all game pieces 30 on all targets 70 count, even if covered by the opponent. For example, if the first Player tosses two game pieces 30 onto a target 70 designated with the number three, that counts as six points. If the second Player tosses three game pieces 30 on that same target area 70, she has nine points. During play, if either Player exceeds a total score of twenty-one, he or she automatically loses the game, regardless how many game pieces 30 tossed.

The Players keep track of the games won on the score pads 34. The one winning the most games after completion of the predetermined number of games is the Winner.

VI. WORD GAME

Figure 7B:
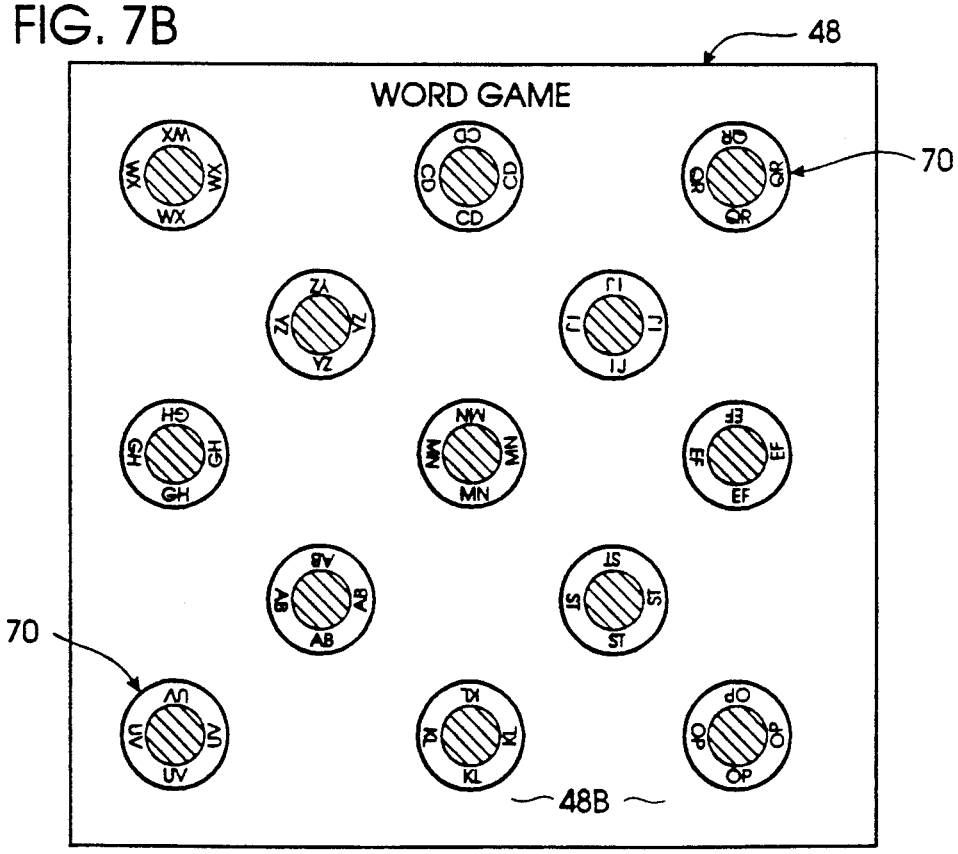
FIG. 7B is a top plan view of a word game.

Each of the thirteen green target areas 70 on the playing surface 48B of board 48 (FIG. 7B) designate two letters of the alphabet Players begin the game with ten game pieces 30 each. The first Player tosses his ten game pieces 30 onto the playing surface 55. After all ten have been tossed, any "junk" 77 is removed and re-tossed until all of that Player's game pieces 30 have been attached to a target area. The Player writes down all letters covered on a score pad 34.

After all Players have tossed, each Player has five minutes to construct as many words as possible from the letters on his score pad 34. Each letter on a Player's score pad 34 may be used as many times as the Player wishes in constructing words. For example, if a Player covers target areas MN, IJ, ST and OP, the word MISSISSIPPI could be constructed.

The Winner is the Player constructing the most words in five minutes.

Figure 8:
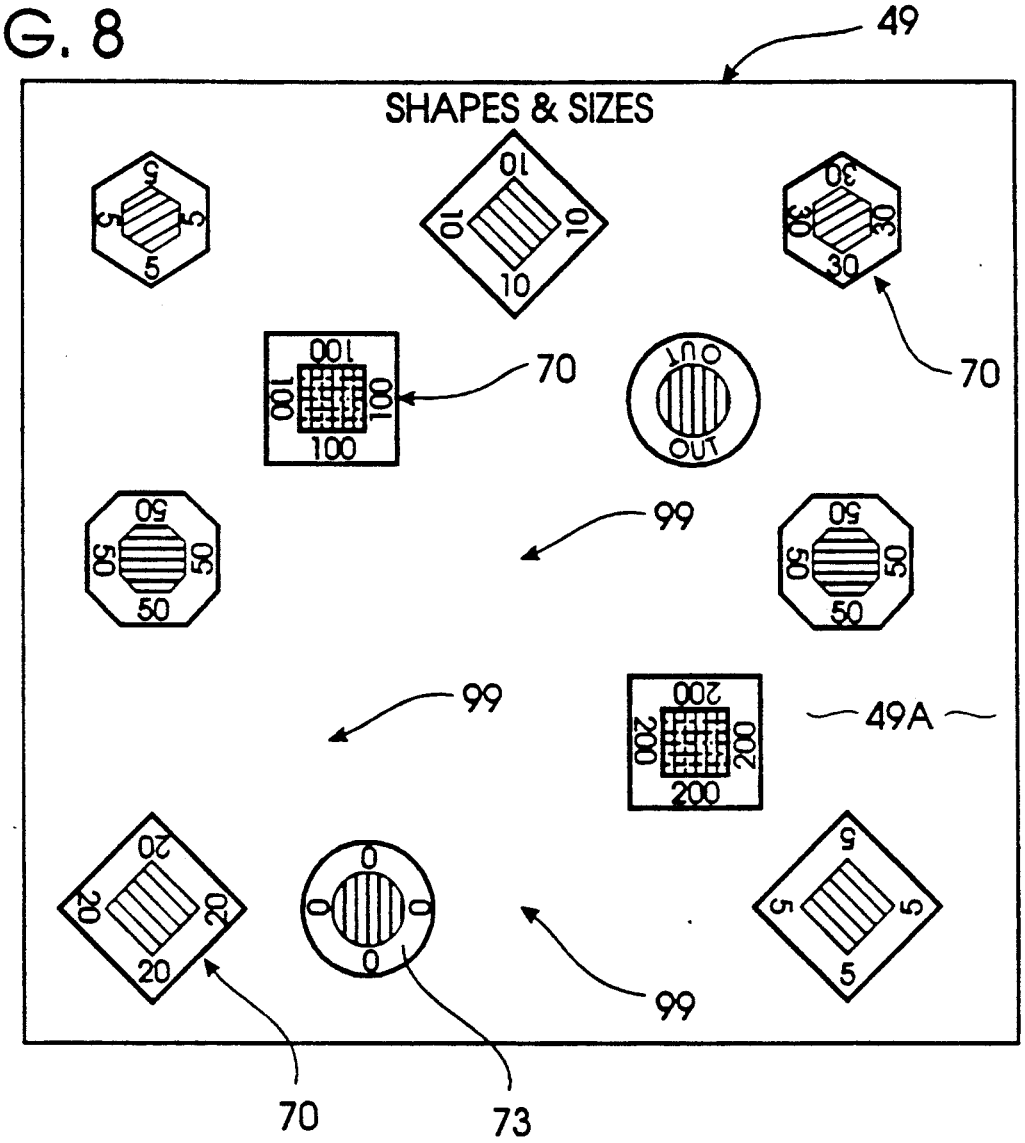
FIG. 8 is a top plan view of a playing surface illustrating target areas of various shapes, denominations and sizes along with parasite areas.

FIG. 8 illustrates a game board 49 having a playing surface 49A wherein random points are awarded or deducted for tossing game pieces 30. Unlike the other playing surfaces, playing surface 49A contains a target 73 that is not aligned with a lower magnet 58 underneath the playing surface. Also the various targets have different sizes and shapes. Parasite areas 99 will hinder a game piece 30 reaching a target 70 or 73. Points are awarded to players based upon numbered values shown on the illustrated targets.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An amusement game comprising:

a plurality of magnetically attractable game pieces;

at least two interchangeable playing surfaces, each of said playing surfaces comprising a plurality of individual targets that can be contacted by said pieces;

a receptacle for removably mounting a selected playing surface to dispose it and said targets for play;

a plurality of magnets disposed within said receptacle in predetermined fixed positions in registration with at least a plurality of said targets for influencing the movement of said pieces impacting a playing surface;

rules associated with each playing surface for governing the awarding of points during play of said game; and, whereby each of said surfaces, when mounted to said receptacle, will present targets that are aligned with said magnets to affect said game pieces when tossed at said surfaces.

2. The game as defined in claim 1 wherein said magnets are oriented with their poles aligned.

3. The game as defined in claim 1 wherein said receptacle comprises:

a box-like enclosure having an internal floor in which said magnets are disposed;

peripheral walls surrounding said floor; and a receptive volume defined between said walls above said floor for securely receiving the desired playing surface.

4. The game as defined in claim 3 further comprising a protective, transparent cover sheet adapted to be disposed upon the selected playing surface within said volume.

5. The game as defined in claim 1 wherein one playing surface has targets marked with preselected letters of the alphabet, and said rules award points based upon words or phrases spelled with letters in targets contacted by said pieces.

6. The game as defined in claim 1 wherein one playing surface comprises colored targets marked with points for establishing an additive score in accordance with said rules, and a differently colored target for reducing the score when contacted by a piece.

7. The game as defined in claim 1 wherein the targets of one playing surface are linked together into individual groups.

8. The game as defined in claim 1 wherein the targets of one playing surface are marked as either "RUNS" or "OUTS" and the rules define a baseball strategy for play.

* * * * *